US010343271B2

(12) United States Patent
Campbell

(10) Patent No.: US 10,343,271 B2
(45) Date of Patent: Jul. 9, 2019

(54) DRIVING TOOL WITH INTERNAL AIR COMPRESSOR

(71) Applicant: BLACK & DECKER INC., New Britain, CT (US)

(72) Inventor: David C. Campbell, Bel Air, MD (US)

(73) Assignee: Black & Decker Inc., New Britain, CT (US)

( * ) Notice: Subject to any disclaimer, the term of this patent is extended or adjusted under 35 U.S.C. 154(b) by 0 days.

(21) Appl. No.: 15/950,649

(22) Filed: Apr. 11, 2018

(65) Prior Publication Data

US 2018/0229353 A1 Aug. 16, 2018

Related U.S. Application Data

(63) Continuation of application No. 14/597,620, filed on Jan. 15, 2015, now Pat. No. 9,969,070, which is a continuation of application No. 13/354,366, filed on Jan. 20, 2012, now Pat. No. 9,050,712.

(60) Provisional application No. 61/434,534, filed on Jan. 20, 2011.

(51) Int. Cl.
*B25C 1/04* (2006.01)
*B25D 9/08* (2006.01)

(52) U.S. Cl.
CPC ..... *B25C 1/047* (2013.01)

(58) Field of Classification Search
CPC ..... B25C 1/047; B25C 1/04; B25D 9/08
USPC ..... 227/130
See application file for complete search history.

(56) References Cited

U.S. PATENT DOCUMENTS

| | | | | |
|---|---|---|---|---|
| 1,071,387 | A | 8/1913 | Behr | |
| 3,771,710 | A | 11/1973 | Perkins et al. | |
| 3,821,992 | A | 7/1974 | Matsuo | |
| 3,878,902 | A | 4/1975 | Matsuo | |
| 4,215,808 | A * | 8/1980 | Sollberger | B25C 1/041 173/204 |
| 6,648,202 | B2 | 11/2003 | Miller et al. | |
| 7,210,607 | B2 | 5/2007 | Niblett et al. | |
| 7,431,103 | B2 | 10/2008 | Schell et al. | |
| 7,527,106 | B2 | 5/2009 | Miller et al. | |
| 7,793,811 | B1 | 9/2010 | Pedicini et al. | |
| 7,850,055 | B2 | 12/2010 | Niblett et al. | |
| 8,002,160 | B2 | 8/2011 | Larkin et al. | |
| 8,079,504 | B1 | 12/2011 | Pedicini et al. | |
| RE44,001 | E | 2/2013 | Pedicini et al. | |
| 8,523,035 | B2 | 9/2013 | Pedicini et al. | |

(Continued)

FOREIGN PATENT DOCUMENTS

| | | |
|---|---|---|
| WO | WO2007048006 | 4/2007 |
| WO | WO2011010634 | 1/2011 |

*Primary Examiner* — Michelle Lopez
(74) *Attorney, Agent, or Firm* — Stephen R. Valancius

(57) ABSTRACT

A driving tool having first and second linear motors, a head assembly, a nosepiece and a driver. The first linear motor forms an air compressor and includes a scotch yoke mechanism for translating a first piston in a first cylinder. The scotch yoke mechanism includes a crank arm, a crank arm roller, which is coupled to the crank arm, and a connecting rod having a roller slot into which the crank arm roller is received. At least a portion of the roller slot is configured to vary an output rate at which the connecting rod translates along a translation axis relative to an input rate at which the crank arm roller moves in a direction that is parallel to the translation axis.

15 Claims, 13 Drawing Sheets

(56) References Cited

U.S. PATENT DOCUMENTS

| | | | | |
|---|---|---|---|---|
| 8,550,324 | B2 | 10/2013 | Coleman | |
| 8,561,869 | B2 | 10/2013 | Towfighi | |
| 2002/0158102 | A1* | 10/2002 | Patton | B25C 1/04 227/8 |
| 2006/0108391 | A1 | 5/2006 | Leasure | |
| 2007/0045377 | A1* | 3/2007 | Towfighi | B25C 1/04 227/130 |
| 2008/0023520 | A1 | 1/2008 | Marshall et al. | |
| 2008/0190988 | A1* | 8/2008 | Pedicini | B25C 1/04 227/130 |
| 2009/0020300 | A1 | 1/2009 | Braddock | |
| 2010/0213235 | A1 | 8/2010 | Pedicini | |
| 2012/0187178 | A1 | 7/2012 | Campbell | |

* cited by examiner

DRIVING TOOL WITH INTERNAL AIR COMPRESSOR

CROSS-REFERENCE TO RELATED APPLICATIONS

This application is a continuation of U.S. patent application Ser. No. 14/597,620 filed Jan. 15, 2015, which is a continuation of U.S. application Ser. No. 13/354,366, filed Jan. 20, 2012, now U.S. Pat. No. 9,050,712 issued Jun. 9, 2015, which claims the benefit of U.S. Provisional Patent Application No. 61/434,534 filed Jan. 20, 2011. The entire contents of these priority applications are incorporated herein by reference.

FIELD

The present disclosure relates to a driving tool with an internal air compressor.

Driving tools of various types are known in the art. One such type of driving tool employs a pneumatic motor that is coupled to a source of compressed air. While such tools are typically lightweight and relatively inexpensive, they require an air compressor and an air hose that can be inconvenient to use. Additionally the air compressor may be relatively heavy and expensive.

Another type of driving tool employs a rotating flywheel to impart energy to a driver, such as the DC628K and DC616K cordless finish nailers marketed by DeWalt of Towson, Md. While such tools provide increased portability and convenience, they are nonetheless relatively complicated and expensive.

A further type of driving tool employs an internal combustion engine to generate a gaseous byproduct that is employed to propel a driver. Such tools typically require a relatively expensive fuel canister, as well as a source of electricity to control the operation of the tool. Moreover, some users have concerns for the cleanliness of the combustion process and the need for periodic maintenance.

A last type of driving tool is described in U.S. Patent Application Publication No. 2008/0190988 and employs an internal air compressor. While such tool may perform well for its intended function, we note that it is nonetheless susceptible of improvement.

SUMMARY

This section provides a general summary of the disclosure, and is not a comprehensive disclosure of its full scope or all of its features.

In one form, the present teachings provide a driving tool that includes a motor and transmission, a first linear motor, a second linear motor, a head assembly, a nosepiece, and a driver. The motor and transmission have an output member that is rotatable about a rotational axis. The first linear motor forms an air compressor and includes a scotch yoke mechanism, a first cylinder and a first piston. The scotch yoke mechanism is driven by the output member to reciprocate the first piston along a translation axis in the first cylinder. The translation axis is perpendicular to and intersects the rotational axis. The second linear motor has a second cylinder and a second piston that is slidably disposed in the second cylinder. The head assembly controls fluid communication between the first and second cylinders. The nosepiece is coupled to the second cylinder. The driver is received in the nosepiece and is coupled to the second piston for movement therewith. The scotch yoke mechanism includes a crank arm, which is coupled to the output member for rotation therewith, a crank arm roller, which is mounted on the crank arm, and a connecting rod with a roller slot into which the crank arm roller is received. At least a first portion of the roller slot is configured to vary an output rate at which the connecting rod translates along the translation axis relative to an input rate at which the crank arm roller moves in a direction that is parallel to the translation axis.

In another form, the present teachings provide a driving tool that includes a motor and transmission, a first linear motor, a second linear motor, a head assembly, a nosepiece, and a driver. The motor and transmission have an output member that is rotatable about a rotational axis. The first linear motor forms an air compressor and includes a scotch yoke mechanism, a first cylinder and a first piston. The scotch yoke mechanism is driven by the output member to reciprocate the first piston along a translation axis in the first cylinder. The translation axis is perpendicular to and intersects the rotational axis. The second linear motor has a second cylinder and a second piston that is slidably disposed in the second cylinder. The head assembly controls fluid communication between the first and second cylinders. The nosepiece is coupled to the second cylinder. The driver is received in the nosepiece and is coupled to the second piston for movement therewith. The scotch yoke mechanism includes a crank arm, which is coupled to the output member for rotation therewith, a crank arm roller, which is mounted on the crank arm, and a connecting rod with a roller slot into which the crank arm roller is received. The roller slot has a slot axis and a location of any point along the slot axis is defined by a first vector, which is coincident with the translation axis, and a second vector that is orthogonal to the rotary and translation axes. At least a first portion of the roller slot is shaped such that the first vector decreases as the second vector increases.

In still another form, the present teachings provide a driving tool that includes a motor, a first linear motor, a second linear motor, a head assembly, a nosepiece and a driver. The first linear motor forms an air compressor and has a scotch yoke mechanism, a first cylinder and a first piston. The scotch yoke mechanism is driven by the motor to reciprocate the first piston in the first cylinder. The second linear motor has a second cylinder and a second piston that is slidably disposed in the second cylinder. The head assembly controls fluid communication between the first cylinder and the second cylinder. The nosepiece is coupled to the second cylinder. The driver is coupled to the second cylinder for movement therewith and is received in the nosepiece. The scotch yoke mechanism includes a crank arm, a crank arm roller mounted on the crank arm, and a connecting rod with a roller slot into which the crank arm roller is received. A first portion of the roller slot is formed generally perpendicular to an axis along which the first piston reciprocates. A second portion of the roller slot is formed in an arcuate manner.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
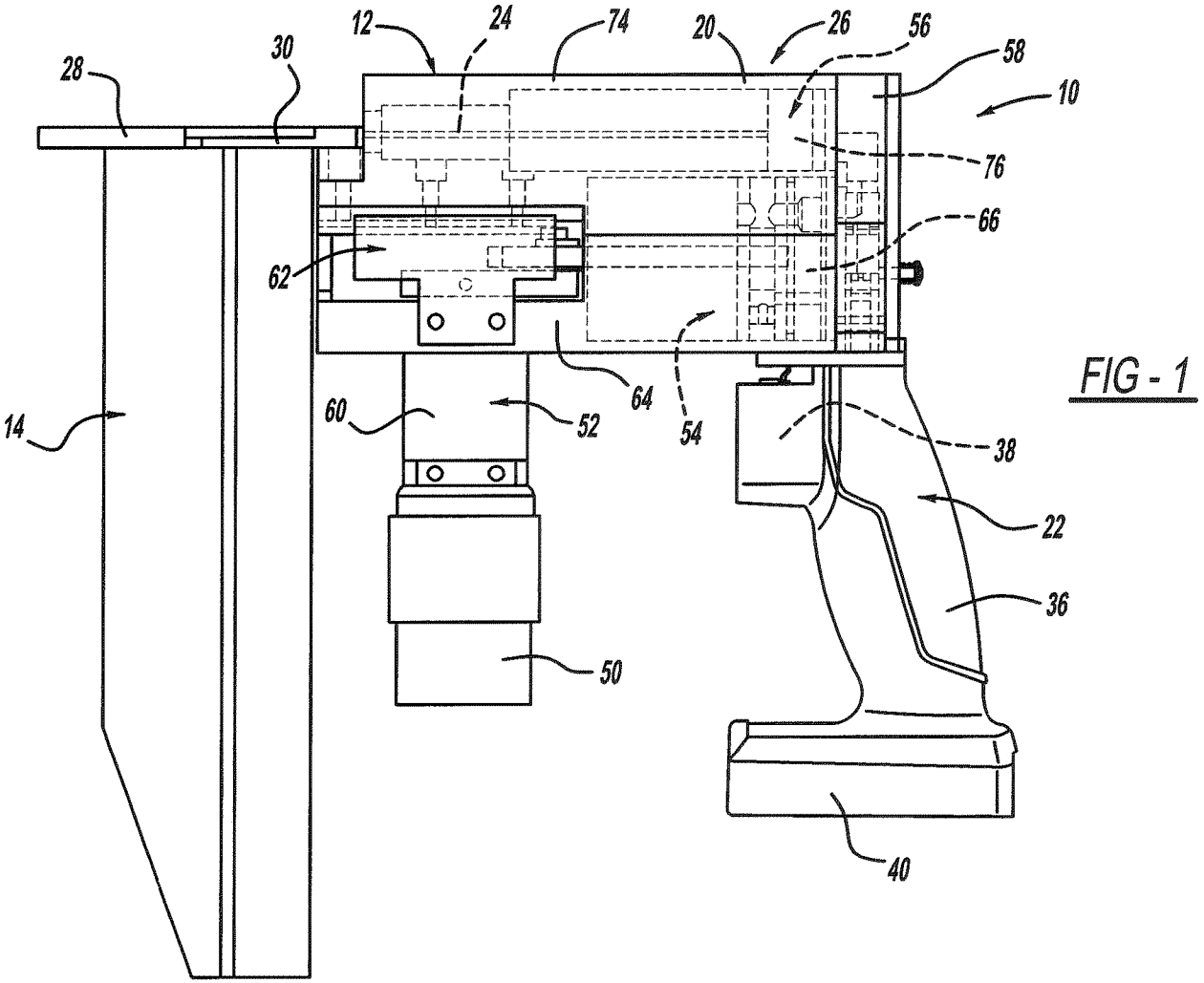
FIG. 1 is a side elevation view of a first exemplary driving tool constructed in accordance with the teachings of the present disclosure.
Figure 15:
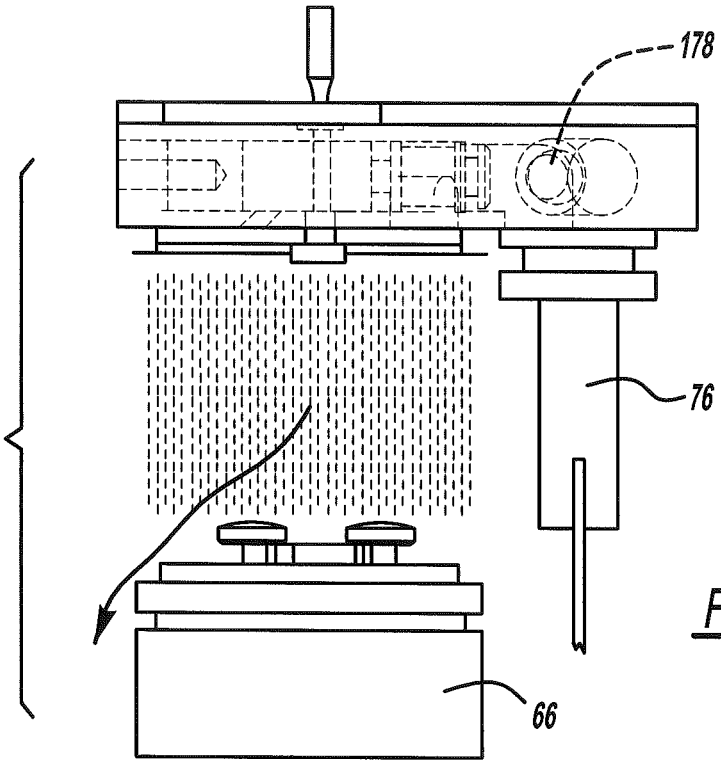
Figure 11:
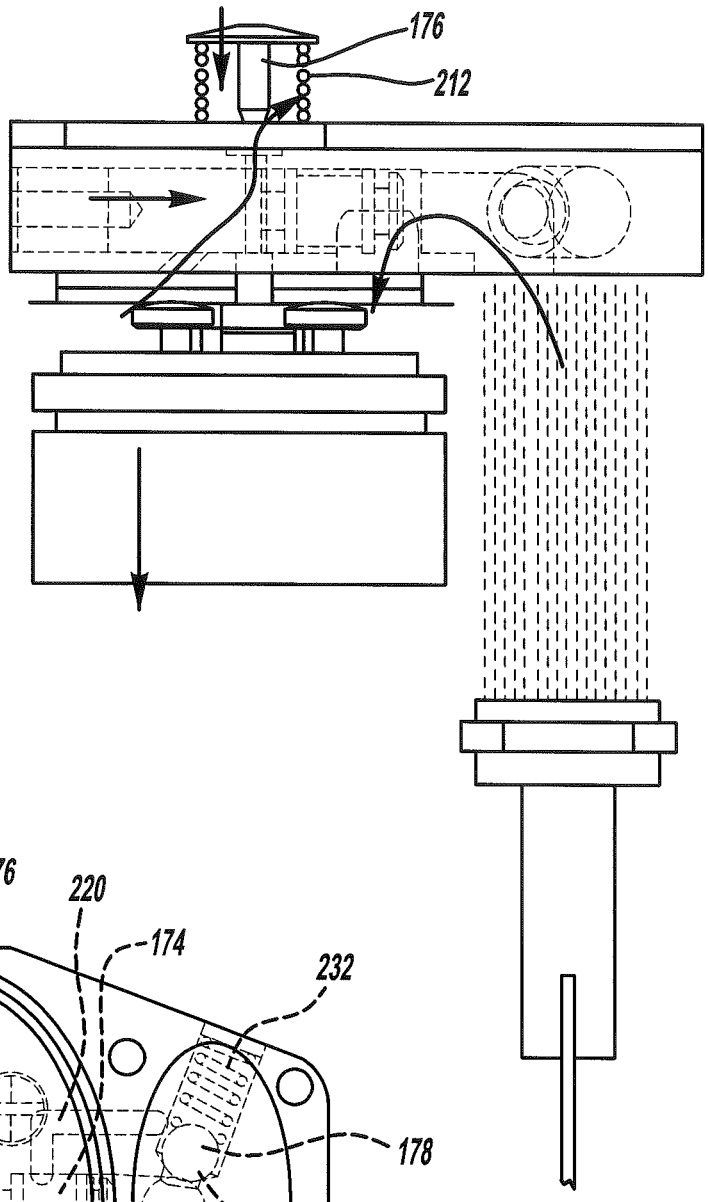
FIG. 11 is a side elevation view of a portion of the driving tool of FIG. 1, illustrating the piston of the first linear motor moving away from top-dead-center and the cylinder of the second linear motor venting through the head assembly into the cylinder of the first linear motor.
Figure 12:
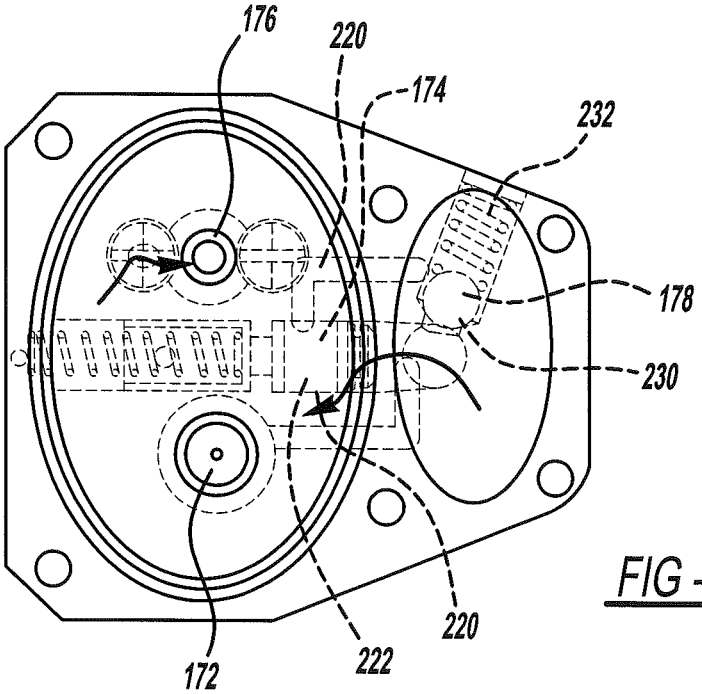
FIG. 12 is a bottom plan view of the head assembly depicting the flow of air through the head assembly when the cylinder of the second linear motor venting through the head assembly into the cylinder of the first linear motor.
Figure 13:
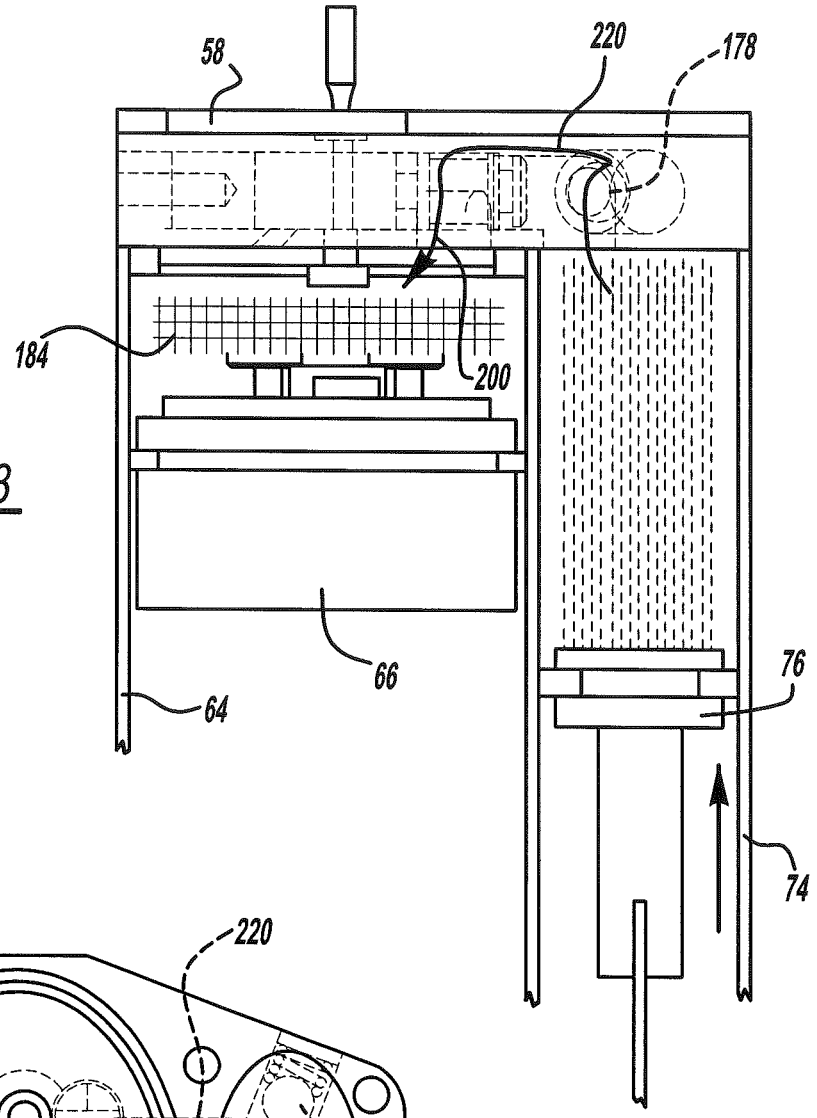
Figure 14:
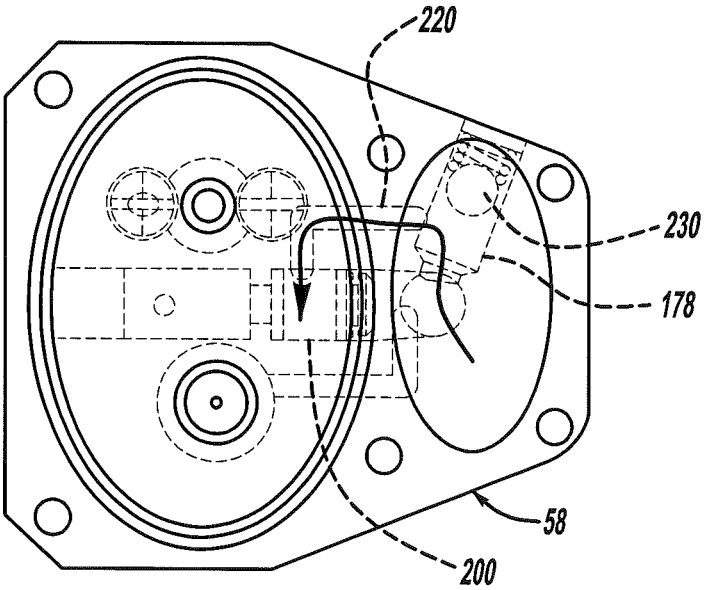
Figure 16:
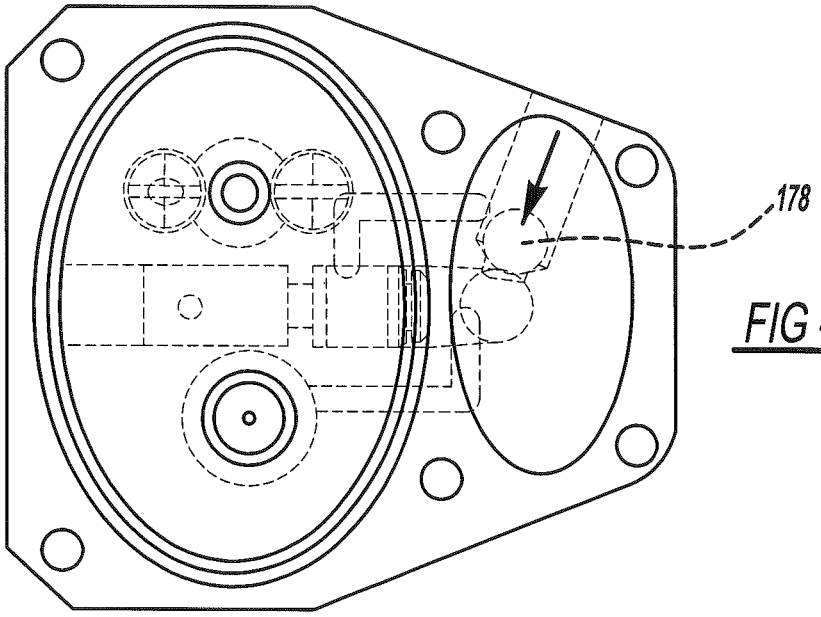
Figure 17:
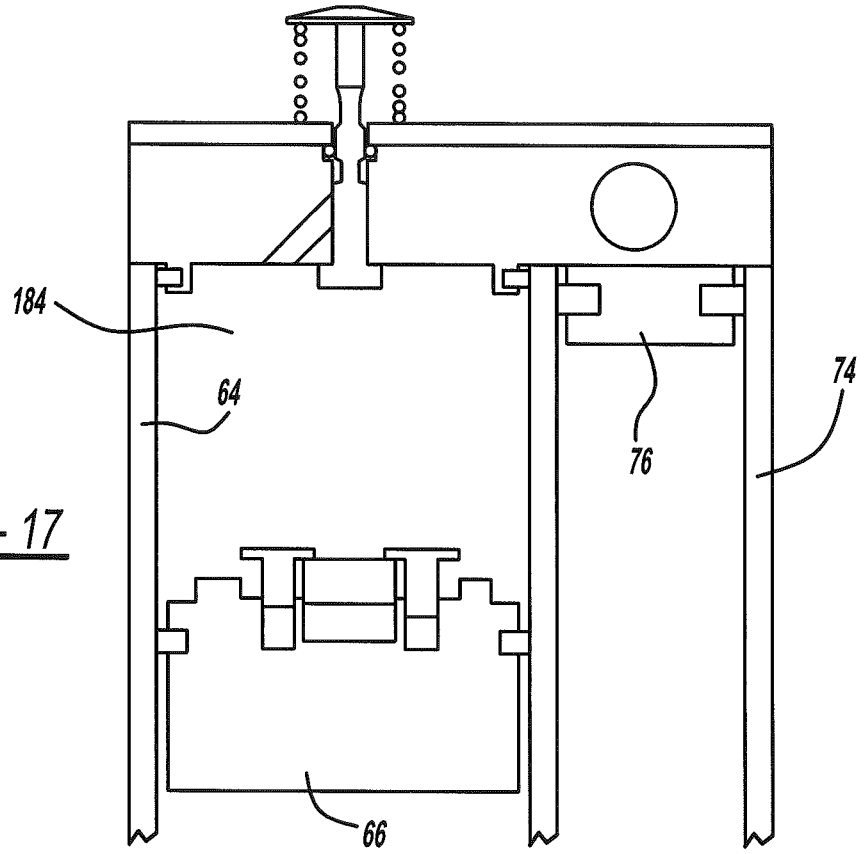

FIG. 13 is a side elevation view of a portion of the driving tool of FIG. 1, illustrating the piston of the first linear motor moving away from top-dead-center, fluid being transmitted from the cylinder of the second linear motor through the head assembly into the cylinder of the first linear motor, and the piston of the second linear motor moving toward the head assembly in response to a corresponding pressure differential acting on the piston;

FIG. 14 is a bottom plan view of the head assembly depicting the flow of air through the head assembly when the piston of the second linear motor is moving toward the head assembly as shown in FIG. 13;

FIG. 15 is a side elevation view of a portion of the driving tool of FIG. 1, illustrating the piston of the second linear motor in a returned position adjacent the head assembly, the piston of the first linear motor at bottom-dead-center, and the opening of an intake valve that permits fluid communication between the cylinder of the first linear motor and the atmosphere;

FIG. 16 is a bottom plan view of the head assembly depicting the closing of a check valve in the head assembly after the piston of the first linear motor is positioned at bottom-dead-center and the intake valve has been opened;

FIG. 17 is a section view of a portion of the driving tool of FIG. 1, illustrating the piston of the first linear motor at bottom-dead-center and the piston of the second linear motor in the returned position adjacent the head assembly; and FIGS. 18 through 21 are section views of a portion of another exemplary driving tool constructed in accordance with the teachings of the present disclosure, the several illustrations depicting movement of the pistons and fluid flow through the head assembly.

Corresponding reference numerals indicate corresponding parts throughout the several views of the drawings.

DETAILED DESCRIPTION

With reference to FIG. 1 of the drawings, a driving tool constructed in accordance with the teachings of the present disclosure is generally indicated by reference numeral 10. The driving tool 10 can be configured to perform any type of driving activity, such as punching (i.e., holes), riveting and fastening. In the particular example provided, the driving tool 10 is a brad nailer that is configured to drive brads (not shown) into a workpiece (not shown). The driving tool 10 can comprise a tool body 12 and a magazine assembly 14. The tool body 12 can comprise a tool housing 20, a control handle 22, a driver 24, a drive motor assembly 26, a nosepiece 28 and a contact trip assembly 30. The nosepiece 28, which can be fixedly coupled to the tool body 12, the contact trip assembly 30, which can be slidably mounted on the nosepiece 28 and can interact with the control handle 22 to selectively permit operation of the driving tool 10, and the magazine assembly 14, which can be fixedly coupled to the nosepiece 28 and/or the tool body 12 and can be configured to hold and sequentially feed fasteners (i.e., brads in the example provided) into the nosepiece 28, can be conventional in their construction and operation and as such need not be discussed in significant detail herein.

The control handle 22 and the drive motor assembly 26 can be mounted to the tool housing 20. The control handle 22 can include a handle 36, which provides a means for a user to orient the driving tool 10, as well as a controller and "switches" (which can comprise any combination of mechanical switches, such as a trigger switch 38, and/or solid state switches, such as transistors) that can be employed to control the operation of the driving tool 10. In the example provided, the driving tool 10 is an electrically operated tool and as such, the controller and switches are employed to selectively provide electric power from a power source, such as a battery pack 40 that is removably coupled to a distal end of the handle 36, to the drive motor assembly 26.

The drive motor assembly 26 can comprise a rotary motor 50, a transmission 52, an internal air compressor or first linear motor 54, a second linear motor 56, and a head assembly 58. The transmission 52 can include a gear reduction unit 60. The first linear motor 54 can comprise a scotch yoke mechanism 62, a first cylinder 64 and a first piston 66. The second linear motor 56 can include a second cylinder 74 and a second piston 76. The head assembly 58 can be coupled to the first and second cylinders 64 and 74 and can control fluid transfer therebetween.

The rotary motor 50 can be any type of electric motor and can receive electric power from the battery pack 40 as controlled through the control handle 22. The rotary motor 50 can be mounted to the gear reduction unit and can output rotary power to the gear reduction unit 60. The gear reduction unit 60 can be fixedly mounted to the first cylinder 64.

The gear reduction unit 60 can be configured to perform a speed reduction and torque multiplication function and to output rotary power to the scotch yoke mechanism 62. The gear reduction unit 60 can be any type of gear reduction, but in the particular example provided comprises a two-stage planetary reduction.

Figure 2:
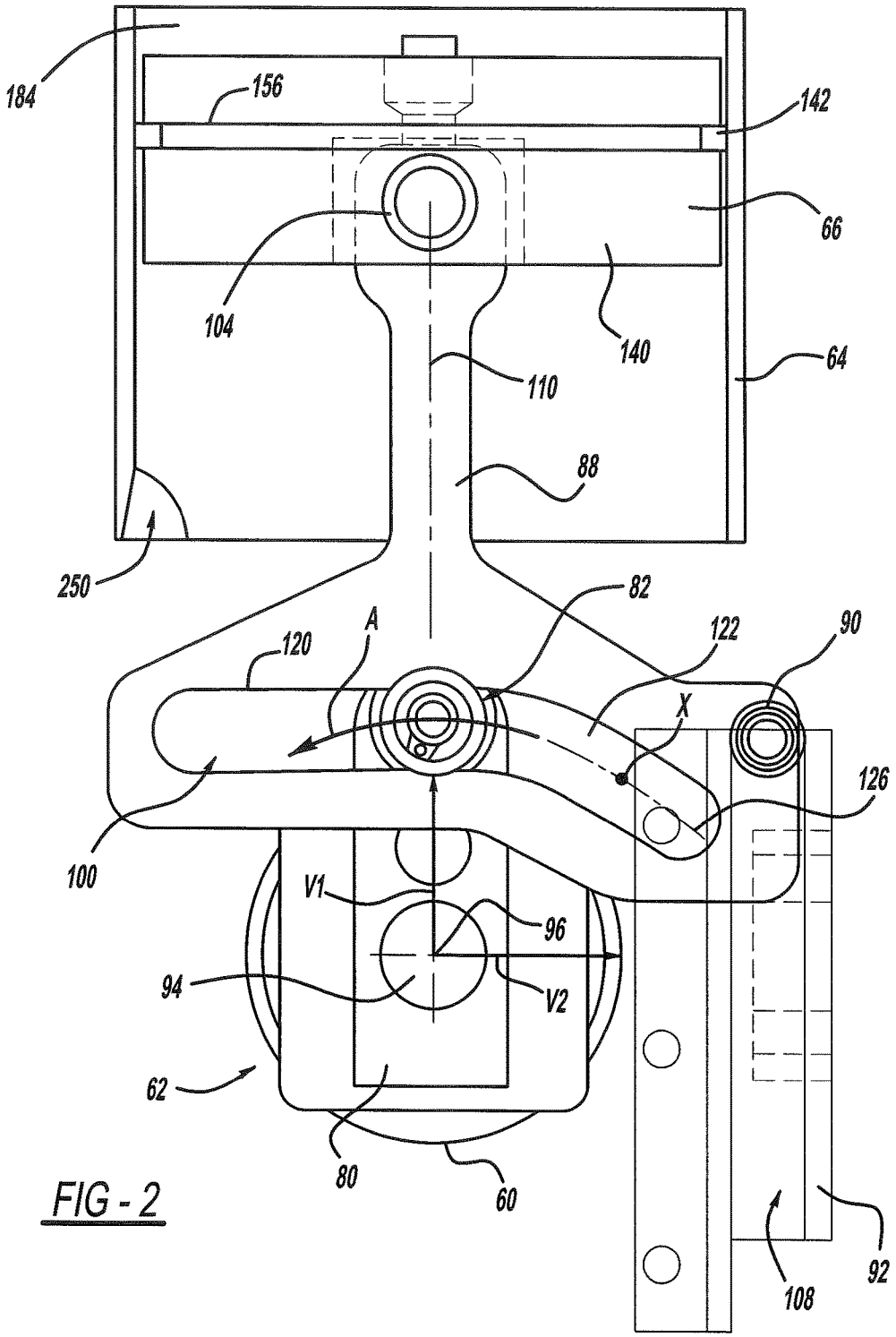
FIG. 2 is a side elevation view of a portion of the driving tool of FIG. 1 illustrating a portion of a rotary motor, a transmission and a first linear motor in more detail.
Figure 3:
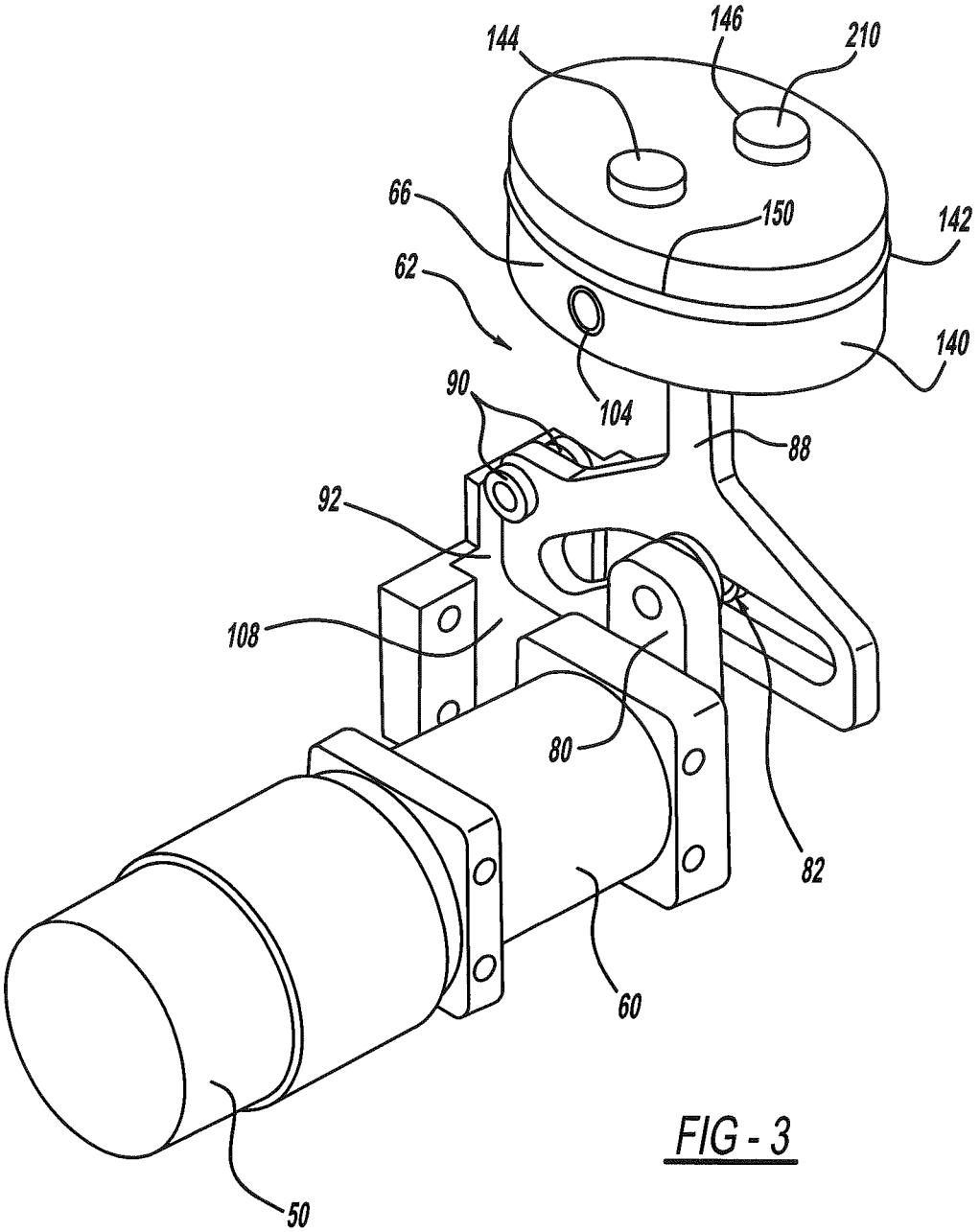
FIG. 3 is a perspective view of the portion of the driving tool illustrated in FIG. 2.

With reference to FIGS. 2 and 3, the scotch yoke mechanism 62 can include a crank arm 80, a crank arm roller 82, a connecting rod 88, a plurality of guide rollers 90 and a guide rail 92. The crank arm 80 can be coupled to an output member 94 of the gear reduction unit 60 for rotation therewith. The crank arm roller 82 can be mounted to an end of the crank arm 80 such that rotation of the crank arm 80 in response to operation of the rotary motor 50 will cause corresponding orbital rotation of the crank arm roller 82 about the rotational axis 96 of the output member 94 of the gear reduction unit 60 as designated by arrow A. The connecting rod 88 can be received in the first cylinder 64 and can define a roller slot 100 into which the crank arm roller 82 can be received. An end of the connecting rod 88 opposite the roller slot 100 can be pivotally coupled to the first piston 66 via a wrist pin 104. The guide rollers 90 can be coupled to the connecting rod 88 and can be mounted within a guide rail slot 108 in the guide rail 92. It will be appreciated that the guide rail 92 and guide rollers 90 cooperate to constrain movement of the connecting rod 88 along a predetermined translation axis 110 as the crank arm 80 rotates about the rotational axis 96.

The roller slot 100 can comprise a first slot portion 120 and a second slot portion 122. The first slot portion 120 can be formed in a conventional manner for a scotch yoke mechanism (i.e., normal to a translation axis 110 along which an output coupled to the scotch yoke mechanism 62, i.e., the first piston 66 in the example provided, translates). The second slot portion 122 can be formed in an unconventional manner in which at least a portion of the second slot portion 122 is formed to effectively reduce the maximum rotational torque required of the rotary motor 50 to move the first piston 66 through a portion of its stroke, such as from bottom-dead-center (BDC) to top-dead-center (TDC). The roller slot 100 can have a longitudinal or slot axis 126 in which a location of any point along the slot axis 126 (e.g., point X) can be defined by a first vector V1, which is coincident or parallel to the translation axis 110, and a second vector V2 that is orthogonal to the rotational axis 96 and the translation axis 110. Those of skill in the art will appreciate that the second vector V2 is the shortest distance between the center of the crank arm roller 82 and the rotational axis 96 and as such, corresponds to an effective moment arm of the crank arm 80. The second slot portion 122 can be configured such that the first vector V1 decreases as the second vector V2 increases. The rate at which the first vector V1 decreases relative to the increase of the second vector V2 can be constant or can vary in a desired manner. Stated another way, the second slot portion 122 can be configured such that the output rate at which the connecting rod 88 translates along the translation axis 110 varies in a desired manner relative to an input rate at which the crank arm roller 82 moves in a direction that is parallel to the translation axis 110. For example, the slot axis 126 of the second slot portion 122 can be arcuate or straight in shape. In situations where the slot axis 126 through the second slot portion 122 follows a circular arc so that the variation in the output rate is based on a square of a change in the length of the effective moment arm of the crank arm 80 that occurs when the crank arm 80 rotates about the rotational axis 96. In situations where the slot axis 126 through the second slot portion 122 follows a straight path, the variation in the output rate is proportional to a change in the length of the effective moment arm of the cram arm 80 that occurs when the crank arm 80 rotates about the rotational axis 96. For purposes of comparison, the first slot portion 120 is configured such that the output rate is equal to the input rate.

In the particular example provided, the second slot portion 122 is configured to effectively reduce the maximum rotational torque required of the rotary motor 50 to move the first piston 66 from bottom-dead-center (BDC) to top-dead-center (TDC) and the second slot portion 122 is configured to direct load toward the guide rail 92 and, with reference to the orientation shown in FIG. 2, in an upward direction as the first piston 66 is moved from BDC to TDC, which can reduce the couple that is produced (i.e., relative to a configuration in which the second slot portion 122 was a mirror image of the straight formed first slot portion 120) as the first piston 66 is moved from BDC to TDC.

Figure 4:
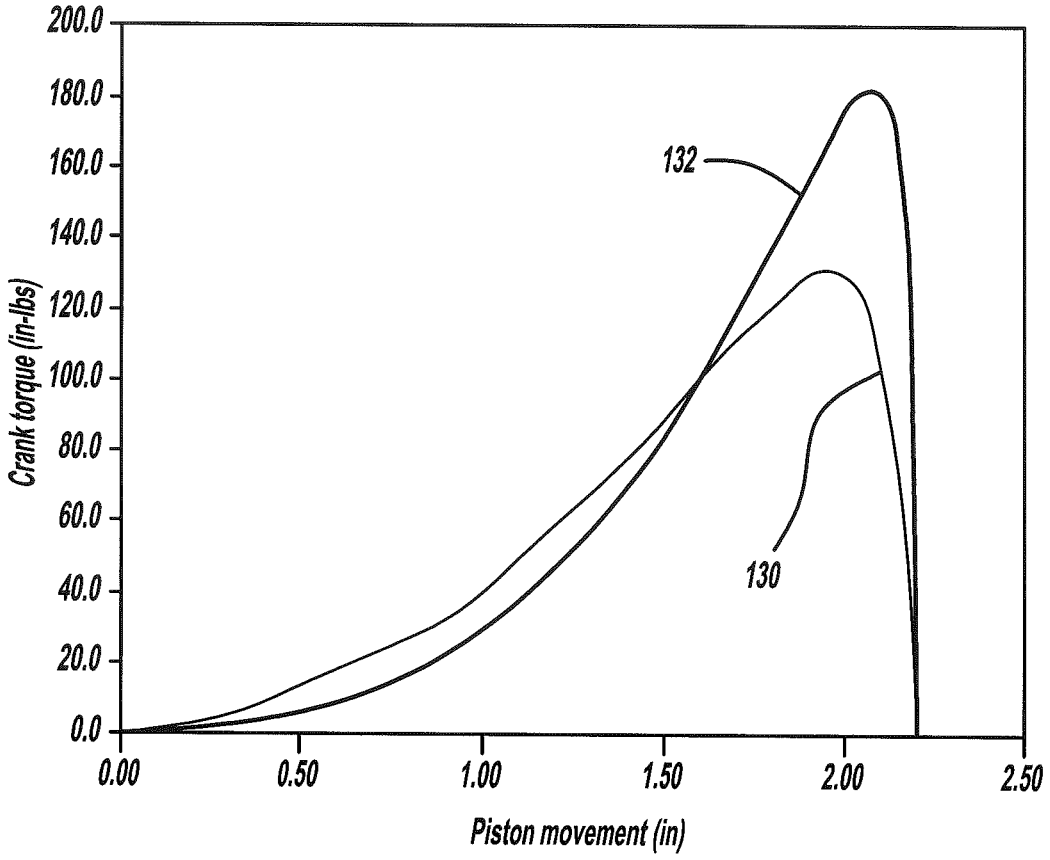
FIG. 4 is a plot depicting the torque required for movement of a piston using two different piston translating means.

Reference numeral 130 in FIG. 4 is a plot of the calculated torque required to move the first piston 66 (FIG. 2) employing the scotch yoke mechanism 62 (FIG. 2) described herein. Reference numeral 132 in FIG. 4 is a plot of the calculated torque required to move the first piston 66 (FIG. 2) employing a conventional system that employs an inline slider crank mechanism having a crankshaft and a connecting rod.

Figure 5:
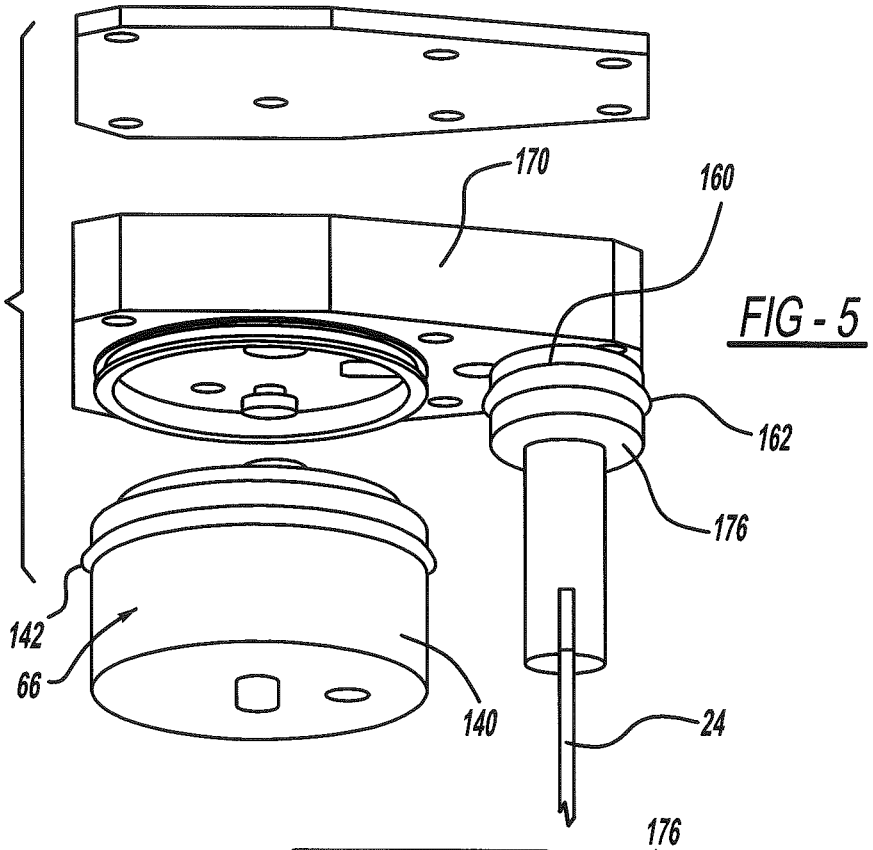
FIG. 5 is an exploded perspective view of a portion of the driving tool of FIG. 1 illustrating pistons of first and second linear motors and a head assembly.

With reference to FIGS. 2, 3 and 5, the first piston 66 can comprise a piston body 140, a compression ring 142, a first valve actuator 144 and a second valve actuator 146. The piston body 140 can be slidably received within the first cylinder 64 and is coupled to the connecting rod 88 such that rotation of the rotary motor 50 causes corresponding reciprocation of the piston body 140. The compression ring 142 can be mounted within a ring groove 150 formed in the piston body 140 and can form a wear resistant seal between the piston body 140 and the inside surface of the first cylinder 64.

With reference to FIGS. 1 and 5, the second cylinder 74 can be fixedly coupled to the first cylinder 64 such that their longitudinal axes are parallel to one another. It will be appreciated, however, that the axes of the first and second cylinders 64 and 74 can be oriented differently. In the particular example provided, the first and second cylinders 64 and 74 are integrally formed with the tool body 12.

The second piston 76 can be slidably received within the second cylinder 74 and can comprise a seal groove 160 into which a piston seal 162 can be received. The piston seal 162 can form a wear-resistant but relatively low-friction seal between the second piston 76 and the interior surface of the second cylinder 74. The driver 24 can be fixedly coupled to the second piston 76 such that translation of the second piston 76 will cause corresponding movement of the driver 24. A distal end (not shown) of the driver 24 can be received within the nosepiece 28 and as will be appreciated by those of skill in the art, can be driven against a fastener (not shown) in the nosepiece 28 to drive the fastener into a workpiece (not shown).

Figure 6:
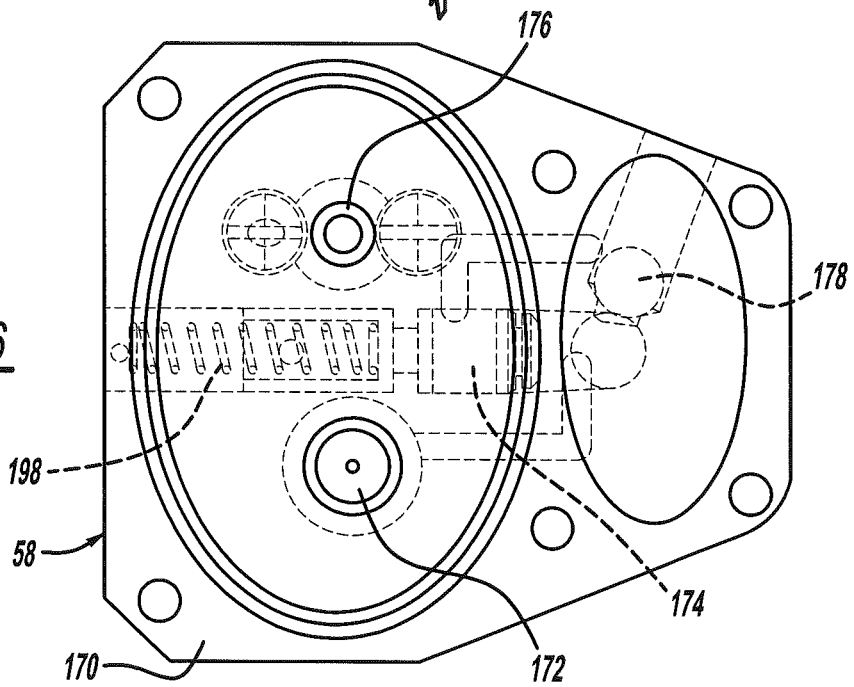
FIG. 6 is a bottom plan view of the head assembly.
Figure 7A:
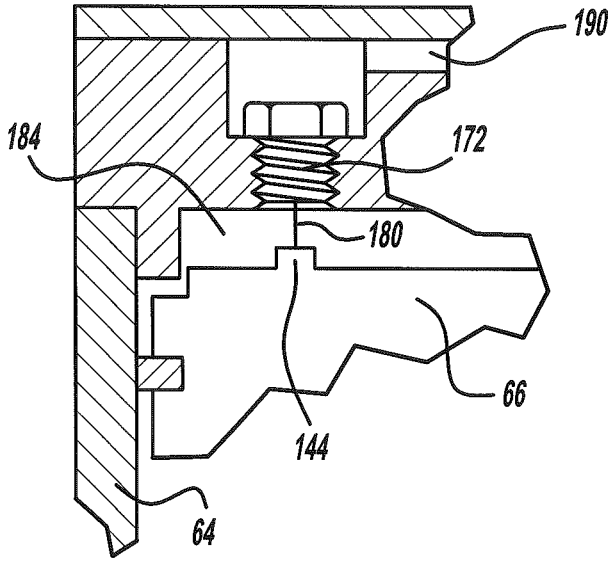
FIG. 7A is a section view of a portion of the driving tool of FIG. 1 illustrating the piston of the first linear motor at top-dead-center.
Figure 7B:
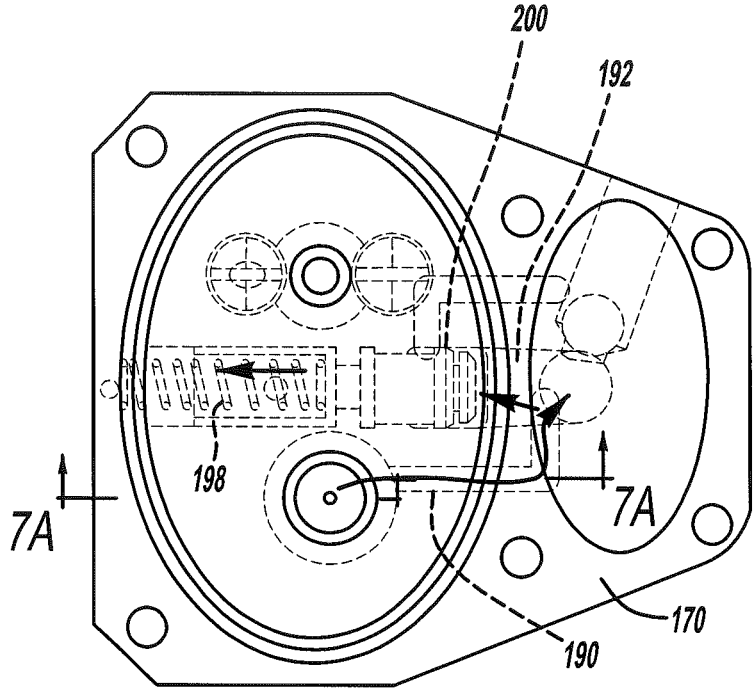
FIG. 7B is a view similar to that of FIG. 6 but depicting fluid flow through a first valve and related movement of a directional valve.
Figure 8:
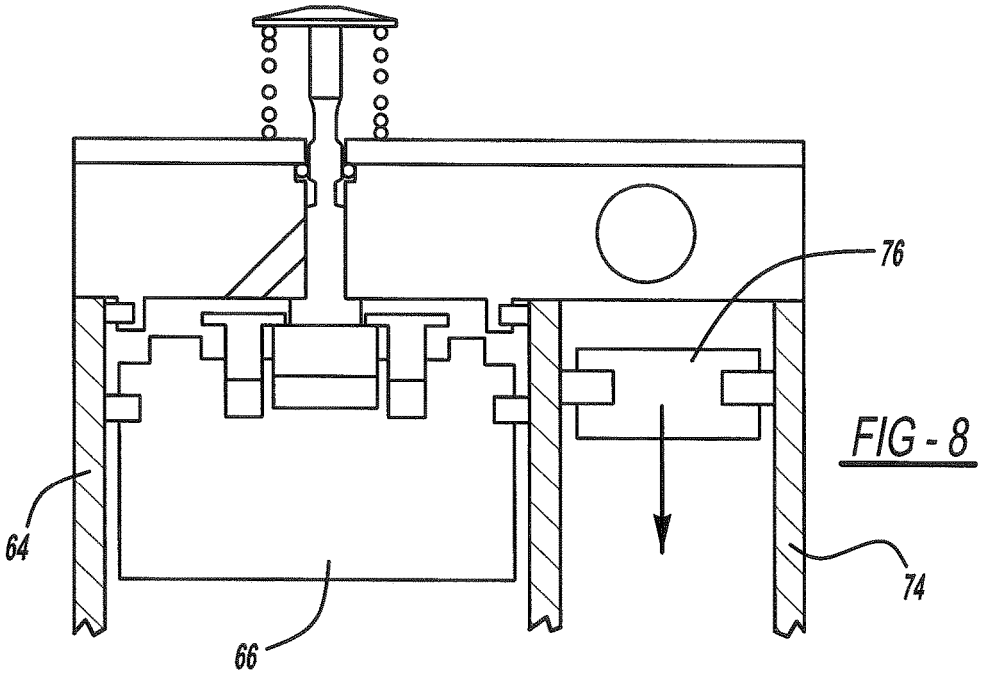
FIG. 8 is a section view of a portion of the driving tool of FIG. 1, illustrating the piston of the first linear motor at top-dead-center and the piston of the second linear motor moving away from the head assembly.
Figure 9:
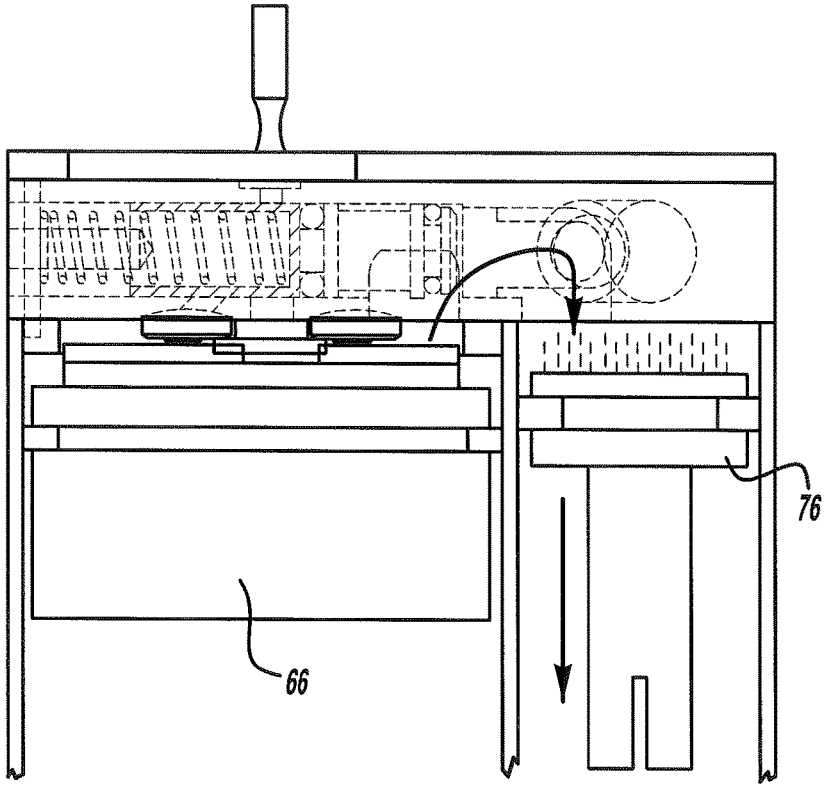
FIG. 9 is a side elevation view of a portion of the driving tool of FIG. 1 illustrating the piston of the first linear motor at top-dead-center and the piston of the second linear motor moving away from the head assembly.
Figure 10:
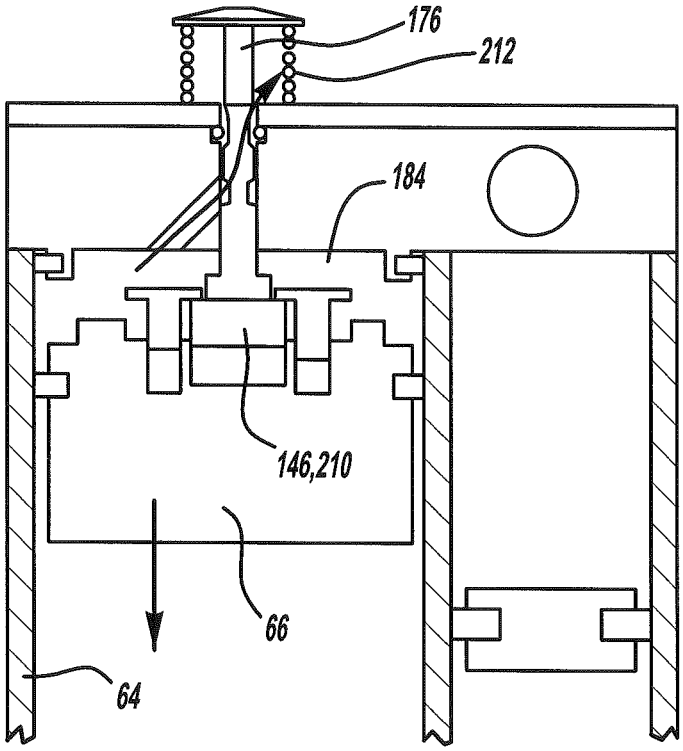
FIG. 10 is a section view of a portion of the driving tool of FIG. 1, illustrating the piston of the first linear motor moving away from top-dead-center and the piston of the second linear motor at the end of its stroke away from the head assembly.

With reference to FIGS. 5 and 6, the head assembly 58 can comprise a head structure 170, a first valve 172, a second or directional valve 174, a third or vent valve 176, and a check valve 178. The head structure 170 can be fixedly and sealingly coupled to the first and second cylinders 64 and 74 (FIG. 1) and can define a plurality of passages or fluid conduits that can cooperate with the several valves to control the transfer of pressurized fluid through the head assembly 58.

With reference to FIGS. 3 and 7A through 9, the first valve 172 is configured to open as the first piston 66 approaches TDC in the first cylinder 64. It will be appreciated that any means may be employed to control the opening of the first valve 172. In the particular example provided, the first valve 172 is a poppet valve having a valve stem 180 that is contacted by the first valve actuator 144 on the first piston 66 as the first piston 66 approaches TDC to open the first valve 172. Opening of the first valve 172 permits compressed air to flow from the first portion 184 of the first cylinder 64 through a first fluid conduit 190 in the head structure 170 and into the second cylinder 74. It will be appreciated that the sudden inrush of pressurized fluid into the second cylinder 74 can cause the second piston 76 to move away from the head assembly 58 and toward the nosepiece 28 such that the driver 24 will strike a fastener residing in the nosepiece 28 and drive that fastener into a workpiece.

A second fluid conduit 192 formed in the head structure 170 can direct fluid pressure from the second cylinder 74 to the directional valve 174 to cause the directional valve 174 to shift against the bias of a first valve spring 198 to open a third fluid conduit 200. The second fluid conduit 192 and the third fluid conduit 200 can create a flow path between the first and second cylinders 64 and 74 that is parallel to the flow path provided by the first fluid conduit 190. The second and third fluid conduits 192 and 200 may be sized to permit a higher flow rate of air between the first and second cylinders 64 and 74 as compared with the first fluid conduit 190.

With reference to FIGS. 3 and 10 through 12, the vent valve 176 can be any type of normally closed valve, such as a poppet valve. A vent valve opening means, such as a cam or a pneumatic circuit, can be employed to open the vent valve 176 to permit the vent valve 176 to vent the first cylinder 64 (e.g., to the atmosphere) after a sufficient delay or lag (e.g., after the second piston 76 has completed its stroke toward the nosepiece 28 and the driver 24 has driven the fastener into the workpiece). In the particular example provided, the vent valve opening means comprises the second valve actuator 146, which has a magnet 210 that is fixedly coupled to the first piston 66. The magnet 210 is configured to magnetically attract the vent valve 176 as the first piston 66 approaches or reaches TDC such that the vent valve 176 moves against the bias of a second valve spring 212 and engages the magnet 210 to thereby permit fluid within the first portion 184 of the first cylinder 64 to vent. In the particular example provided, venting of the first cylinder 64 occurs as the first piston 66 moves away from TDC and after the first valve 172 closes. The reduced fluid pressure within the first fluid conduit 192 causes the directional valve 174 to return to its spring-biased position. The check valve 178 is disposed in a fluid path between the second cylinder 74 and a fourth fluid conduit 220 leading to a valve body portion 222 of the directional valve 174. The third fluid conduit 200 is disposed between the valve body portion 222 of the directional valve 174 and the first cylinder 64.

As the first piston 66 moves away from TDC and toward BDC, the pressure of the fluid in the second cylinder 74 exceeds that of the falling pressure of the fluid in the first cylinder 64, which causes the check valve 178 to open. In the example provided, the check valve 178 comprises a ball 230 that is biased by a third valve spring 232 into a closed position and opens in response to a predetermined pressure differential between the first and second cylinders 64 and 74. It will be appreciated that as the chamber in which the ball 230 of the check valve 178 is sealed to the atmosphere, downward movement of the first piston 66 in the first cylinder 64 as shown in FIG. 13 will reduce the pressure of the fluid in the first portion 184 of the first cylinder 64 to maintain the check valve 178 in an open condition that permits fluid communication between the second and first cylinders 74 and 64 when the first piston 66 travels toward BDC as shown in FIGS. 13 and 14.

Since the nosepiece 28 (FIG. 1) is open to the atmosphere and therefore exposes a side of the second piston 76 opposite the head assembly 58 to atmospheric pressure, the second piston 76 will move toward the head assembly 58 as a result of pressure differentials. More specifically, movement of the first piston 66 toward BDC while the first and second cylinders 64 and 74 are in fluid communication will result in increased volume and therefore a lower absolute pressure in the portion of the second cylinder 74 between the second piston 76 and the head assembly 58. Simultaneously, an opposite side of the second piston 76 is exposed to atmospheric air, which has a higher absolute pressure. This pressure differential produces a force that acts on the second piston 76 to drive the second piston 76 toward the head assembly 58.

With reference to FIGS. 2 and 15 through 17, an intake valve 250 may be opened as the first piston 66 approaches or reaches BDC to permit fluid pressure within the first portion 184 of the first cylinder 64 to return to atmospheric pressure to thereby cause the check valve 178 to close and to re-charge the first cylinder 64 with sufficient air for a next operational cycle. The intake valve 250 can include an opening that permits air to flow past the compression ring 142 into the interior of the first cylinder 64. The opening can comprise one or more ports in the sidewall of the first cylinder 64 that permit atmospheric air to enter the interior of the first cylinder 64 as the compression ring 142 passes by them as the first piston 66 approaches BDC. In the particular example provided, a flow path is formed in the sidewall of the first cylinder 64 that permits air to flow by the compression ring 142 into the interior of the first cylinder 64.

A second driving tool constructed in accordance with the teachings of the present disclosure is generally indicated by reference numeral **10*a* in FIGS. 18 through 21**.

Figure 18:
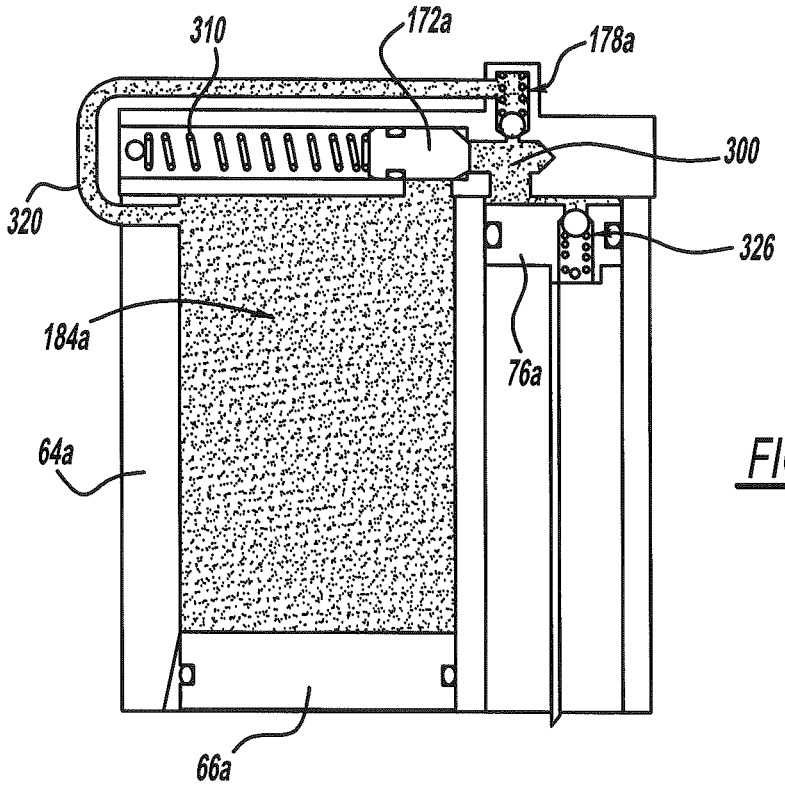

In FIG. 18, the first piston **66*a* is disposed in close proximity to BDC and air at approximately atmospheric air pressure is disposed in the first portion 184*a* of the first cylinder 64*a*. A first passage 300 connects the first and second cylinders 64*a* and 74*a* in fluid communication with one another. A first valve 172*a* is biased by a first spring 310 into a closed position that blocks fluid communication between the first and second cylinders 64*a* and 74*a*. A second passage 320 couples the first cylinder 64*a* in fluid communication with the first passage 300 at a location between the first valve 172*a* and the second cylinder 74*a*. A first check valve 178*a* is disposed in the second passage 320. An inertia valve 326 is disposed in the second piston 76*a* and is biased into a closed position (which inhibits fluid communication through the second piston 76*a*) by a valve spring 350**.

Figure 19:
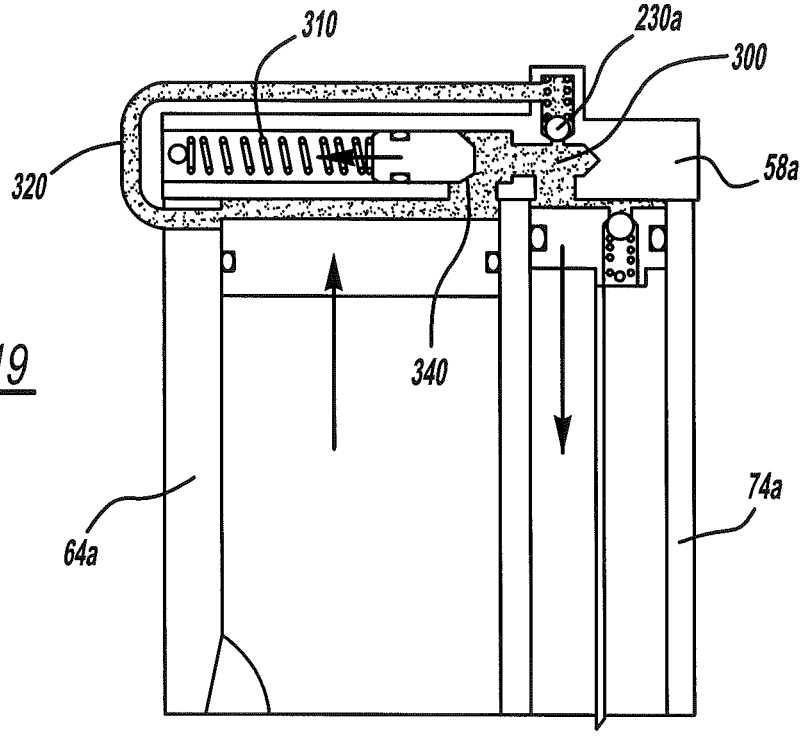

In FIG. 19, the first piston **66*a* moves toward TDC to thereby elevate the fluid pressure in the second passage 320. Elevated fluid pressure in the second passage 320 helps to maintain the ball 230*a* of the first check valve 178*a* in a closed condition so that pressurized fluid is not discharged through the second passage 320 into the first passage 300. Elevated pressure in the first passage 300, however, is applied to an annular face 340 of the first valve 172*a*, which applies an axially directed force on the first valve 172*a* that causes the first valve 172*a* to shift (i.e., to the left in the example provided) against the bias of a first valve spring 310** to thereby permit fluid communication between the first and second cylinders 64*a* and 74*a*. Elevated fluid pressure in the second cylinder 74*a* causes the second piston 76*a* to travel in the second cylinder 74*a* away from the head assembly 58*a*.

Figure 20:
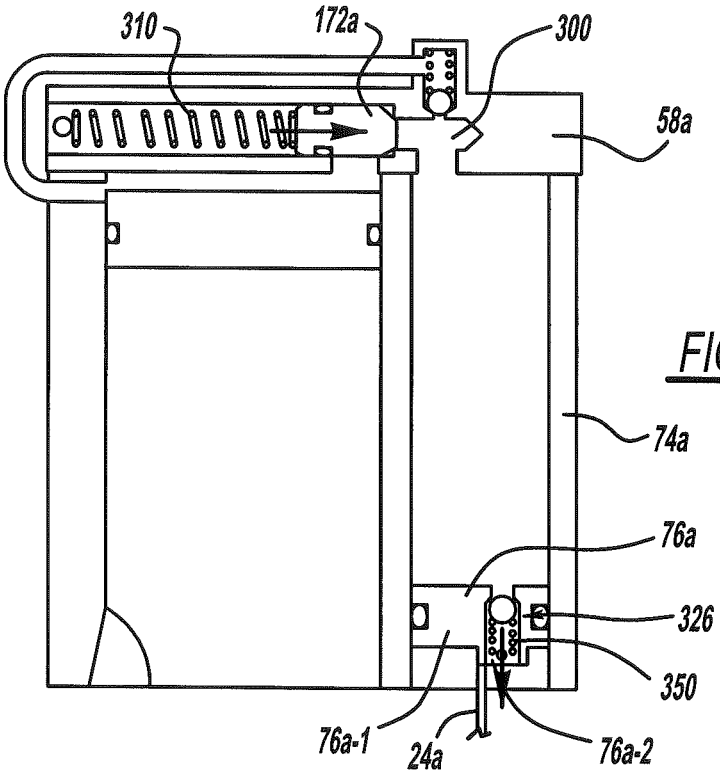

In FIG. 20 the second piston 76*a* is shown at the end of its stroke away from the head assembly 58*a*. The inertia valve 326 can open against the bias of the valve spring 350 due to the mass of the movable valve core 76*a*-1 undergoing rapid deceleration as the driver 24*a*, which is propelled by the second piston 76*a*, completes the driving of the fastener into the workpiece. The opening of the inertia valve 326 allows the second cylinder 74*a* and the first passage 300 to vent through a passage 76*a*-2 in the valve core 76*a*-1 to the atmosphere. It will be appreciated that the venting of the second cylinder 74*a* will permit the first valve spring 310 to return the first valve 172*a* to its closed position. Once the deceleration of the second piston 76*a* has ceased, the inertia valve 326 will thereafter close to inhibit further fluid communication between the atmosphere and the portion of the second cylinder 74*a* between the head assembly 58*a* and the second piston 76*a*.

Figure 21:
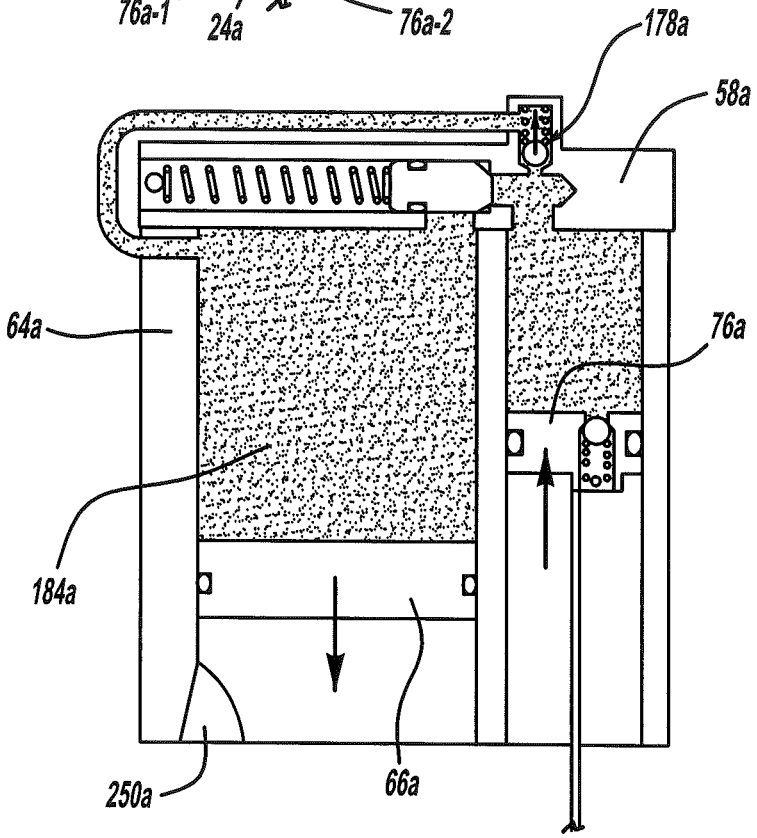

In FIG. 21 the first piston 66*a* is moved toward BDC. The increasing volume between the first piston 66*a* and the head assembly 58*a* results in an air pressure within the first portion 184*a* of the first cylinder 64*a* that is less than atmospheric air pressure, which causes the check valve 178*a* to open and to permit atmospheric air pressure acting on the second piston 76*a* to return the second piston 76*a* to a position adjacent the head assembly 58*a*.

An intake valve 250*a* may be opened as the first piston 66*a* approaches or reaches BDC to permit fluid pressure within the first portion 184*a* of the first cylinder 64*a* to return to atmospheric pressure to thereby cause the check valve 178*a* to close and to re-charge the first cylinder 64*a* with sufficient air for a next operational cycle.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hand-held driving tool comprising:

a tool body;

a nosepiece;

a magazine assembly coupled to at least one of the nosepiece and the tool body and configured to hold and sequentially feed fasteners to the nosepiece;

a motor in the tool body;

a first cylinder housed in the tool body, the first cylinder having a sidewall; a first end and a second end;

a piston;

a driver coupled to the piston for movement therewith; and a valve formed in the sidewall of the first cylinder which allows atmospheric air to enter the interior of the first cylinder;

further comprising a second cylinder, the piston disposed in the second cylinder; and an inertia valve disposed in the piston and biased into a closed position;

wherein the first cylinder and the second cylinder share at least one wall; and wherein the first cylinder includes a first longitudinal axis, the second cylinder includes a second longitudinal axis and the first longitudinal axis and the second longitudinal axis are parallel to one another.

2. The hand-held driving tool of claim 1, wherein the driver is configured to contact the fastener fed to the nosepiece to drive the fastener into a workpiece.

3. The hand-held driving tool of claim 1, further comprising a battery pack which powers the motor.

4. The hand-held driving tool of claim 3, further comprising a handle, and wherein the battery pack is removably coupled to a distal end of the handle.

5. The hand-held driving tool of claim 4, further comprising a user-actuatable trigger disposed on the handle.

6. The hand-held driving tool of claim 1, wherein the valve is located adjacent an end of the first cylinder.

7. The hand-held driving tool of claim 1, further comprising at least one passage between the first cylinder and the second cylinder.

8. A hand-held driving tool comprising:

a tool body;

a nosepiece;

a magazine assembly coupled to at least one of the nosepiece and the tool body and configured to hold and sequentially feed fasteners to the nosepiece;

a motor in the tool body;

a first cylinder housed in the tool body; the first cylinder having a sidewall, a first end and a second end;

a driver piston;

a driver coupled to the driver piston for movement therewith; and a valve formed in the sidewall of the first cylinder which allows atmospheric air to enter the interior of the first cylinder; and an intertia valve disposed in the driver piston and biased into a closed position.

9. The hand-held driving tool of claim 8, further comprising a second cylinder.

10. The hand-held driving tool of claim 9, wherein the driver piston is disposed in the second cylinder.

11. The hand-held driving tool of claim 10, further comprising a pressurizing piston.

12. The hand-held driving tool of claim 11, wherein the pressurizing piston is disposed in the first cylinder.

13. The hand-held driving tool of claim 12, wherein the pressuring piston includes a piston body and a seal, the seal providing a seal between the piston body and the first cylinder.

14. The hand-held driving tool of claim 13, wherein the seal comprises a compression ring located on the piston body.

15. The hand-held driving tool of claim 14, wherein the pressuring piston is movable in a first direction in which the pressurizing piston pressurizes air in the first cylinder;

wherein the pressuring piston is movable in a second direction, opposite the first direction.

* * * * *